US010081415B1

(12) United States Patent
Sun

(10) Patent No.: US 10,081,415 B1
(45) Date of Patent: Sep. 25, 2018

(54) INTEGRATED WATER SPORTS APPAREL AND WATER SPORTS ACCESSORIES

(71) Applicant: Amy Sun, San Francisco, CA (US)

(72) Inventor: Amy Sun, San Francisco, CA (US)

(73) Assignee: Epic Surf Design Company, LLC, Irvine, CA (US)

( * ) Notice: Subject to any disclaimer, the term of this patent is extended or adjusted under 35 U.S.C. 154(b) by 0 days.

(21) Appl. No.: 15/836,699

(22) Filed: Dec. 8, 2017

(51) Int. Cl.
*B63C 11/04* (2006.01)
*A45F 5/02* (2006.01)
*B63B 35/79* (2006.01)

(52) U.S. Cl.
CPC ..... *B63C 11/04* (2013.01); *A45F 5/02* (2013.01); *B63B 2035/794* (2013.01); *B63C 2011/043* (2013.01); *B63C 2011/046* (2013.01)

(58) Field of Classification Search
CPC . B63C 11/04; A41D 13/0007; A41D 13/0015; A41D 13/02; A41D 1/06; A41B 13/06
See application file for complete search history.

(56) References Cited

U.S. PATENT DOCUMENTS 4,234,990 A * 11/1980 Colburn ..... B63B 35/7933 403/157
5,194,026 A * 3/1993 Corwin ..... B63B 35/7933 280/637
7,798,877 B1 * 9/2010 Wortham ..... B63B 35/7906 441/79
9,549,576 B2 * 1/2017 Conolly ..... A63B 21/00181
2008/0301861 A1 * 12/2008 Meistrell ..... B63C 9/087 2/458
2012/0160858 A1 * 6/2012 Vossman ..... A45C 3/001 220/694
2012/0312852 A1 * 12/2012 Smalley ..... A41D 7/00 224/666
2015/0274265 A1 * 10/2015 Falken ..... B63B 35/7933 441/75
2017/0166287 A1 * 6/2017 Falken ..... B63B 35/7933

* cited by examiner

*Primary Examiner* — Tejash Patel
(74) *Attorney, Agent, or Firm* — HelixIP LLP

(57) ABSTRACT

The disclosure relates to integration of water sports apparel with leashes and other water sports accessories. For example, a wetsuit can be adapted for integration with a leash to reduce entanglement of the leash with a user's feet and eliminate the need to adjust the orientation of the leash on the user during a water sports session.

17 Claims, 2 Drawing Sheets

INTEGRATED WATER SPORTS APPAREL AND WATER SPORTS ACCESSORIES

BACKGROUND OF THE INVENTION

Wetsuits and dry suits of the type used in aquatic sports, such as surfing, windsurfing, water skiing, and scuba diving are typically fabricated from pieces of fully cured or set (no longer thermoplastic), foamed, neoprene rubber. The suits are comprised of various neoprene pieces which are cut into shapes that accommodate a user's anatomy, provide desired elongation, and produce a variety of aesthetic effects. The wetsuit pieces are joined together at seams which are either stitched, adhesively bonded, taped, or a combination of these techniques.

Wetsuits are commonly worn to provide thermal insulation, buoyancy, and abrasion resistance while engaging in various aquatic activities, such as surfing, scuba diving, snorkeling, open water swimming, kayaking, and windsurfing. Wetsuits may be formed from various materials including, for example, neoprene (i.e., polychloroprene) which is a synthetic rubber produced by the polymerization of chloroprene. Neoprene for wetsuits is generally foamed, often with nitrogen gas, to form gas-filled cells within the material, which enhance thermal insulation and buoyancy properties. Typically, backing layers (e.g., nylon textile elements) are secured to opposite surfaces of a neoprene element to impart strength and abrasion-resistance.

Leashes are used in order to maintain possession and control of equipment and accessories while engaging in a water sport. For example, a surf leash may be used by a surfer to maintain possession and control of a surfboard in the ocean. A surf leash (a.k.a. leg rope) can be attached to a surfboard at one end and to the ankle of a surfer at the other end. Thus, if the surfer falls off the surfboard, the surfboard will remain in close proximity to the surfer.

Other accessories may also be used during water sports such as timepieces, cameras, electronics controllers (e.g., for a drone), GPS systems, Fitbits (and other personal fitness electronic devices), and other electronics and peripherals.

Wetsuits, other water sports apparel, leashes, and other water sports accessories are typically designed and manufactured independently, which can lead to inefficiencies and incompatibilities when a water sports participant uses these items together.

SUMMARY OF THE INVENTION

The disclosure relates to integration of water sports apparel and water sports accessories. Water sports apparel can include, for example, wetsuits, dry suits, triathlon suits, rashguards, neoprene shorts, pullovers, gloves, booties, hoods, capris, jackets, boater pants, board shorts, vests, surf shorts, etc. Leashes can be used for surfboards, windsurfing boards, stand-up paddleboards, water skis, other towables, wakeboards, bodyboards, skim boards, kiteboards, fins, etc. In addition to leashes, other water sports accessories include, for example, cameras, Fitbits, other personal fitness electronic devices, timepieces, electronic controllers (e.g., for a drone), smartphones, etc.

In an aspect, the disclosure relates to wetsuits or dry suits with integrated leashes for water sport boards or rideables such as, for example, surfboards, windsurfing boards, stand-up paddleboards, water skies, other towables, wakeboards, bodyboards, kiteboards, or skim boards. The integrated leash can attach to the wetsuit or dry suit at any suitable site, including for example, below the knee (e.g., at the ankle), on the arm (e.g., at the wrist or bicep), or at the waist. The site and/or direction of attachment on the wetsuit or dry suit can be different for regular or goofy footed surfers. For example, the leash can be attached at the right ankle of the wetsuit or dry suit in a regular footed surfer, or at the left ankle of the wetsuit or dry suit in a goofy footed surfer. In addition, the site of attachment of the leash can be at the back of a water sport board or rideable when a user is wearing the wetsuit or dry suit and is positioned on the board or rideable. The leash may be attached to the wetsuit or dry suit by any suitable means including, for example, Velcro, zippers, buttons, clips, adhesive, screws, mating elements, belt buckle assemblies, snaps, etc. The leash can also be attached to the wetsuit or dry suit through a quick release assembly such as, for example, a snap shackle release device (e.g., sold as Re-Leash by Badfish), PFD Quick Release (e.g., sold as Hala Releasable SUP leash by Hala Gear), a leash release pin assembly (e.g., an Easy Clip Leash Release Pin as sold by Dakine, or Silver Cord Surf Leash sold by Silver Cord), quick release belt systems (e.g., NRS and Salamander quick release belts), etc.

The integrated leash can be attached to a water sport board or rideable by appropriate connector assemblies, including for example, a cord, string, wire, line, etc. connected or threaded to a leash plug of the board. The cord, string, wire, line, etc. can be part of the leash itself or can be connected to a suitable part of the leash (e.g., rail saver) for connecting the leash to the board. The leash may attach to the board in a reversible fashion using, for example, Velcro (generically including other hook and loop tapes and closure systems), zippers, buttons, clips, screws, mating elements, belt buckle assemblies, snaps, quick release elements, etc. This reversible attachment allows a wetsuit with an integrated leash to be disconnected from the surfboard at desirable times. The leash may also reversibly attach to the wetsuit (or dry suit or other water sports apparel) so that the leash can be disconnected from the wetsuit at desirable times.

In an aspect, the disclosure also relates to water sports apparel that is adapted for integration with water sports accessories such as, for example, cameras, Fitbits, other personal fitness electronic devices, timepieces, electronic controllers (e.g., for a drone), smartphones, etc. For example, a wetsuit can be adapted for the external attachment of certain water sports accessories such as cameras, timepieces, electronic controllers, smartphones, etc. The water sports accessory can be attached to the wetsuit directly or the water sports accessory can be attached to the wetsuit by a leash, string, chain, clip, carabiner, etc. The point of attachment on the wetsuit can be on an arm (e.g., the wrist or bicep), torso, chest, or leg of the wetsuit. Alternatively, the wetsuit can be configured to allow a water sports accessory to be worn by a user (e.g., in contact with the user's skin) and accessible to the user. For example, the water sports accessory can be worn on the wrist and the wetsuit can be adapted to have a panel that can be opened to provide access to the accessory.

In an aspect, the disclosure also relates to kits for integrating a water sports accessory (e.g., a leash) with a water sports apparel. The kits include one or more attachment assemblies for integrating the water sports accessory with the water sports apparel and one or more fastening assemblies for integrating the attachment assembly or assemblies with the water sports apparel and/or water sports accessory.

BRIEF DESCRIPTION OF THE FIGURES

FIG. 1 shows a wetsuit leg with Velcro strips attached to the ankle region.

DETAILED DESCRIPTION OF THE INVENTION

Figure 1A:
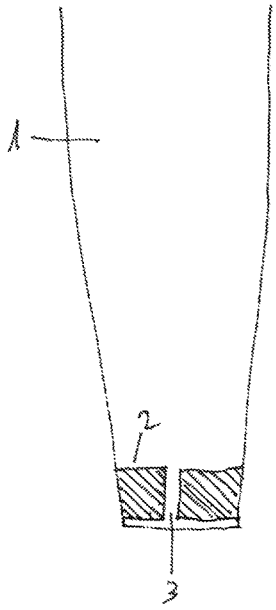
FIG. 1A shows a single discontinuity in the Velcro strip.

Before the various embodiments are described, it is to be understood that the teachings of this disclosure are not limited to the particular embodiments described, and as such can, of course, vary. It is also to be understood that the terminology used herein is for the purpose of describing particular embodiments only, and is not intended to be limiting, since the scope of the present teachings will be limited only by the appended claims.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present teachings, some exemplary methods and materials are now described.

As will be apparent to those of skill in the art upon reading this disclosure, each of the individual embodiments described and illustrated herein has discrete components and features which can be readily separated from or combined with the features of any of the other several embodiments without departing from the scope or spirit of the present teachings. Any recited method can be carried out in the order of events recited or in any other order which is logically possible.

Definitions

In reference to the present disclosure, the technical and scientific terms used in the descriptions herein will have the meanings commonly understood by one of ordinary skill in the art, unless specifically defined otherwise. Accordingly, the following terms are intended to have the following meanings.

As used herein, "attachment assembly" means an assembly for attaching a water sports accessory to a water sports apparel (e.g., a wetsuit). Attachment assemblies may be complementary parts that join or close together. The individual parts and joined together parts are both referred to as attachment assemblies. Exemplary attachment assemblies include, for example, Velcro or other hook and loop tape and closure systems, snaps, zippers, eyelets, adhesives, buckles, buttons, clips, clasps, carabiners, locking assemblies, cinch straps, and quick release assemblies.

As used herein, "complementary" means two parts that can mate, join, integrate, or close together to form a closure or to join together or integrate two things.

As used herein, "fastening assembly" means an assembly or material for attaching an attachment assembly or other item to another item. Fastening assemblies include, for example, hook and loop tape and closure systems (e.g., Velcro), snaps, zippers, eyelets, glue, adhesives, cement, stitching (e.g., needle and/or thread for stitching), etc.

As used herein, "goofy footed" means a board rider leads with the right foot with the left foot behind.

As used herein, "leash plug" and "bar assembly" are used interchangeably and both mean an assembly with a bar around which a cord, Velcro strip, clip, carabiner, other material, or other apparatus can be attached to secure an item (e.g., a water sports accessory). The bar can be rigid (e.g., metal) or flexible (e.g., a cord). The bar can also be straight or curved (e.g., a D-ring). Leash plugs and bar assemblies can be on, above, below, within, or at the surface of a water sports apparatus, a water sports apparel, or a water sports accessory with which the leash plug or bar assembly is integrated.

As used herein, "quick release assembly" means an attachment assembly that can be quickly separated during use so that a user can be separated from an item (e.g., a rideable apparatus).

As used herein, "regular footed" means a board rider leads with the left foot with the right foot behind.

As used herein, "Velcro" means Velcro and other generic hook and loop tapes and closure systems. A Velcro can mean both the hook portion and the loop portion of the closure system. When hooks and loops are mated, a Velcro can also mean the mated combination. A Velcro can be continuous (e.g., a single strip) or discontinuous (e.g., scored or having two or more sections).

As used herein, "water sport" means any sport or activity played on or in water. Water sports include, for example, surfing, body boarding, body surfing, kitesurfing, knee boarding, skim boarding, stand up paddle boarding, wake boarding, water skiing, windsurfing, snorkeling, diving, swimming, etc.

As used herein, "water sports apparatus" means equipment used during a water sport. Water sports apparati include rideable apparati such as, for example, surfboards, windsurfing boards, stand-up paddleboards, water skis, other towables, wakeboards, body boards, skim boards, kiteboards, fins, etc.

As used herein, "water sports apparel" means clothing, garments, and outerwear worn by a user while engaged in a water sport. Water sports apparel includes, for example, wetsuits, dry suits, triathlon suits, rashguards, neoprene shorts, pullovers, gloves, booties, hoods, capris, jackets, boater pants, board shorts, vests, surf shorts, etc.

As used herein, "water sports accessory" means an item that enhances a user's experience while engaging in a water sport. Water sports accessories include, for example, leashes, cameras, Fitbits, other personal fitness electronic devices, timepieces, electronic controllers (e.g., for a drone), smartphones, etc. A water sports accessory includes water sports apparati.

Integrated Water Sports Apparel and Accessories

Water sports apparel, such as wetsuits, can be adapted for integration with water sports accessories, such as leashes. Leashes can be used for rideable apparati such as, for example, surfboards, windsurfing boards, stand-up paddleboards, water skis, other towables, wakeboards, bodyboards, skim boards, kiteboards, etc. Wetsuits can be adapted for integration of a leash on the leg (e.g., at the ankle, just below the knee, at the thigh), at the waist, on the arm (e.g., bicep or wrist), at the torso, etc. The leash attachment sites on the wetsuit can be integrated into the wetsuit and can accept commercially available leashes and/or can be configured to accept leashes customized to integrate with the wetsuit. For example, the attachment site can include Velcro that can mate with the Velcro strap found on commercially available leashes. Alternatively, the attachment site can be a leash plug or bar assembly, e.g., a bar around or through which a leash can be attached. Leashes that are customized to integrate with a wetsuit can mate with the wetsuit attachment site through any number of attachment assemblies including, for example, zippers, buckles, buttons, adhesive, clips, clasps, Velcro, carabiners, bands, locking assemblies, quick release pin assemblies, leash plugs, bar assemblies, etc. The wetsuit and leash may also optionally include a quick release assembly allowing a user to quickly separate the wetsuit from the leash (and board or other water sports apparatus) when needed (e.g., in an emergency). Quick release assemblies include those commercially available with leashes including, for example, the Dakine Easy Clip Leash Release Pin, the NRS quick release belt system, the Badfish Re-Leash system (with a quick draw snap shackle), Salamander SUP quick release belt (adjustable Velcro release system), etc. In some aspects, quick release assemblies are used as the attachment assembly between the leash and the wetsuit or water sports apparel.

Methods for joining together pieces of wetsuit material are described in, for example, U.S. Pat. Nos. 3,171,415, 3,284,257, 3,480,492, 3,615,994, 3,652,354, 4,231,836, 4,416,027, 4,747,894, 4,867,823, and 6,375,770, all of which are incorporated by reference in their entirety for all purposes. The attachment assembly described herein can be attached directly to the wetsuit using the methods described herein or through other methods that are known. Alternatively, the attachment assembly described herein can be attached to wetsuit material and that wetsuit material can be joined to the wetsuit using the methods described herein or through other methods that are known.

In an aspect, Velcro (generically including other hook and loop tapes and closure systems) is adapted for integrating a leash with a wetsuit. In this aspect, a mating surface of Velcro loops or Velcro hooks is attached to the wetsuit at a suitable site for leash attachment (any of those described above). (Velcro loops can be preferred on a wetsuit due to the tendency of Velcro hooks to snag on and damage the wetsuit. They can also permit a commercial leash to be worn in the conventional manner, as the unmated Velcro loops on the wetsuit will not damage or impair the function of the wetsuit or commercial leash.) The leash can have a Velcro strap with a complementary mating surface of Velcro hooks or loops. For example, a strip of Velcro loops can be attached to the ankle region of a wetsuit. This strip of Velcro can be placed on the back leg of a user for surfing applications, which is the right leg for regular footed surfers and the left leg for goofy footed surfers. The leash can have a complementary strip of Velcro hooks on the inner surface of the leash cuff for mating with the Velcro loops on the wetsuit and a user can integrate the leash with the wetsuit by applying the Velcro strips together.

Optionally, the Velcro strip attached to the wetsuit can be discontinuous (e.g., scored or having two or more sections of Velcro) so that the portion of the wetsuit to which the Velcro strip is attached can maintain at least some of its stretching properties to facilitate wetsuit entry and exit. For example, the Velcro can be arranged as parallel vertical strips, staggered horizontal strips, fanciful shapes and designs, logos, text, etc. Also optionally, the base or backing of the Velcro strip can be made of stretchable material. Also optionally, the Velcro strip on the leash can have a complementary strip of Velcro attached to the opposite side, i.e., the outer surface of the leash cuff. This strip of Velcro on the opposite side can provide a more secure connection to the wetsuit by providing a second closure of complementary Velcro strips, i.e., it allows the leash to fasten both to itself (e.g., in an overlapping encircling fashion or wrapping back on itself as in a cinch strap mechanism) and to the wetsuit. It can also allow the leash to be stored in a compact, closed position when not in use. Optionally, another strip of Velcro can be included that is complementary to and can be mated to the Velcro on the wetsuit when it is not in use to protect both the wetsuit and the Velcro strip attached to the wetsuit. This additional strip of Velcro can also mate to the Velcro strip of the leash when the leash is attached to the wetsuit. Optionally, a wetsuit and leash can be integrated by multiple layers of Velcro strips, including layers that fold over one another, as in, for example, current rail saver designs by Dakine. The leash can be used with any appropriate water sports apparatus including, for example, surfboards, windsurfing boards, stand-up paddleboards, water skis, other towables, wakeboards, bodyboards, skim boards, kiteboards, etc. Optionally, the leash can include one or more rail savers and/or swivel assemblies at a desired position(s) on the leash. For example, the leash can have a rail saver at one end or at both ends of the leash cord. A swivel assembly can be placed, for example, between the leash cuff and cord, between the cord and rail saver, between two sections of cord, etc.

A wetsuit can be adapted for integration with a commercial leash by attaching an appropriate strip of complementary Velcro to the wetsuit at a suitable point of attachment so that the Velcro strip on the cuff of the commercial leash can be directly attached to the Velcro strip on the wetsuit. Optionally, an appropriate mating strip of Velcro (attached or not attached to the wetsuit) can secure the Velcro strip at the free end of the cuff of the commercial leash in a loop around the site of attachment. This other strip of Velcro can be attached with the integrated Velcro strip on the wetsuit to protect that strip and the wetsuit when not in use.

In another aspect, a quick release assembly or other attachment assemblies are used for integrating a leash to a wetsuit. In this aspect, one part of the complementary quick release assembly (or attachment assembly) is attached to the wetsuit at a suitable site of attachment. The other part of the complementary quick release assembly (or attachment assembly) is attached to the leash so that the leash is integrated to the wetsuit through the complementary parts of the quick release assembly. Alternatively, the leash and wetsuit are joined together using other attachment assemblies (e.g., zippers, buttons, buckles, etc.) where one part of the attachment assembly is attached to the wetsuit at a suitable site and another part of the attachment assembly is attached to the leash at a suitable site. The parts of the attachment assembly on the wetsuit and leash can be complementary.

In still another aspect, a leash plug, bar assembly, bar, or looped cord can be integrated into a wetsuit at a desired site, and a water sports accessory, e.g., a leash, can attach to the leash plug, bar assembly, bar, or looped cord through a suitable means, e.g., a strip of Velcro similar to a rail saver, a cord, etc.

Other water sports apparel that can be adapted to integrate with a leash can include, for example, dry suits, triathlon suits, rashguards, neoprene shorts, pullovers, gloves, booties, hoods, capris, jackets, boater pants, board shorts, vests, surf shorts, etc. The attachment assemblies described above can be integrated into these other types of water sports apparel at appropriate locations including, for example, at the bicep, wrist, waist, torso, thigh, knee, calf, or ankle, depending on the water sports apparel. As discussed above for wetsuits, one portion of an attachment assembly is joined to the water sports apparel at a desired location and another portion of the attachment assembly is joined to the leash at a desired location. The parts of the attachment assembly on the water sports apparel and leash can be complementary. The leash can be used with any appropriate water sports apparatus including for example, surfboards, windsurfing boards, stand-up paddleboards, water skis, other towables, wakeboards, bodyboards, skim boards, kiteboards, etc.

Wetsuits and other water sports apparel can also be adapted for integration with other water sports accessories.

Water sports accessories can include, for example, cameras, Fitbits, other personal fitness electronic devices, GPS devices, timepieces, electronic controllers (e.g., for a drone), smartphones, etc. A wetsuit or other water sports apparel can be adapted for external attachment of water sports accessories, or for access to water sports accessories that are worn underneath the water sports apparel. Water sports accessories that can be attached and used external to the water sports apparel (e.g., wetsuit) include, for example, cameras, timepieces, electronic controllers, smartphones, etc. These types of water sports accessories can be attached to the wetsuit directly or the water sports accessories can be attached to the wetsuit by a leash, string, cord, chain, clip, carabiner, etc. The point of attachment on the wetsuit can be on an arm (e.g., the wrist or bicep), torso, chest, or leg of the wetsuit depending on how the water sports accessory is to be used during the water sport and how the user will access the accessory. For water sports accessories that are worn underneath or internal to the water sports apparel, the water sports apparel (e.g., wetsuit) can be configured to allow the water sports accessory to be accessible through the water sports apparel. For example, a water sports accessory can be worn on the wrist and a water sports apparel can be adapted to have a panel that can be opened to provide access to the accessory.

In an aspect, kits for integrating a water sports accessory (e.g., a leash or timepiece) with a water sports apparel are also disclosed. The kits include one or more attachment assemblies for integrating the water sports accessory with the water sports apparel and one or more fastening assemblies for integrating the attachment assembly with the water sports apparel and/or the water sports accessory. The fastening assembly can be, for example, a hook and loop tape or closure system (e.g., Velcro), a snap, a zipper, an eyelet, a glue, an adhesive, a cement, stitching (e.g., needle and/or thread for stitching), etc. Integration of the attachment assembly with the water sports apparel and/or water sports accessory can be achieved by one or more fastening assemblies (e.g., a combination of adhesive and stitching). The attachment assembly can be, for example, a Velcro strip (generically covering hook and loop tapes and closure systems), a zipper, a buckle, a quick release assembly, a leash plug, a bar assembly, etc. Examples of quick release assemblies include, for example, the Dakine Easy Clip Leash Release Pin, the NRS quick release belt system, the Badfish Re-Leash system (with a quick draw snap shackle), Salamander SUP quick release belt (adjustable Velcro release system), etc.

Wetsuits

Features of dry suits and wetsuits may vary depending upon the specific aquatic activity or water temperature range for which the suits are designed. As an example, a wetsuit for activities that require significant movement (e.g., surfing and windsurfing) may have backing materials with elastane (i.e., spandex) to reduce limitations on movement while wearing the wetsuit. A wetsuit for scuba diving or colder waters may include water-resistant seals (e.g., rubber cuffs) at the wrist, ankle, and neck openings to limit the entry of water. Additionally, a wetsuit for open water swimming may only include a single layer of backing material located on an inner surface (i.e., facing and contacting the wearer) to reduce drag, although additional texture may be included in arm areas to enhance pull during swimming. Moreover, some wetsuits primarily cover only the torso of a wearer to impart a greater freedom of movement in the arms and legs in warmer water temperatures, while other wetsuits may cover the torso, arms, and legs to impart greater thermal insulation in colder water temperatures. As a further example, wetsuits designed for warmer waters may incorporate relatively thin neoprene elements (e.g., 0.5-2 millimeters), whereas wetsuits designed for colder waters may incorporate relatively thick neoprene elements (e.g., 3-6 millimeters or more). Accordingly, multiple features of wetsuits may vary considerably.

Dry suits and wet suits which are designed for use in cold water are formed from pieces of material, e.g., neoprene rubber material, which can be adhesively bonded together in butt seams so as not to leak water at the seams. Methods for joining together pieces of wetsuit material are described in, for example, U.S. Pat. Nos. 3,171,415, 3,284,257, 3,480,492, 3,615,994, 3,652,354, 4,231,836, 4,416,027, 4,747,894, 4,867,823, and 6,375,770, all of which are incorporated by reference in their entirety for all purposes. Sometimes these suits are also blind stitched and/or taped to reinforce the seams, but using current adhesive bonding techniques, the glued seams can typically have a strength which is at least as great as the foamed neoprene rubber itself. Wetsuits and dry suits can be formed from fully cured neoprene sheets which have a thickness in the range of about 1 to about 6 millimeters, and the foamed neoprene rubber can be both resiliently stretchy and flexible. In some instances, pieces of different thicknesses are bonded together, and often the neoprene will have a nylon fabric bonded to one or both sides of the sheet.

Other materials that can be used to make a wetsuit include, for example, HYPALON® (Dupont), KRATON® (Shell) and various types of foamed plastics, such as urethane, POLARTEC®, LAVACORE®, YULEX®, other plant based polymer rubbers, Technobutter (O'Neill), F'N Lite (Quiksilver, Roxy), E5 (Rip Curl), geoprene, and blends of the foregoing.

Examples of commercially available wetsuits that can be used with or adapted to integrate with the water sports accessories disclosed herein include, for example, wetsuits sold by O'Neill (e.g., Psycho Freak Zen, Psycho Tech, Psycho Tech Fuze, Mutant, Psycho One Zen, Superfreak, Hyperfreak, Heat 3Q-Zip, Epic, Reactor, Bahia, Flair, Hybrid, etc.), Hurley (e.g., Advantage Elite, Advantage Max, Advantage Plus, Phantom Elite, Phantom 403, Phantom Limited, Phantom 202, Fusion 403, Fusion 202, Phantom 303, etc.), Patagonia (e.g., R1 Yulex®, R2 Yulex®, R3 Yulex®, R4 Yulex®, R5 Yulex®, etc.), Rip Curl (e.g., Flash Bomb Plus, Flash Bomb, E Bomb, Dawn Patrol, Aggrolite, Omega, G-Bomb, etc.), Quiksilver (e.g., Syncro, Syncro Plus, Syncro GBS, Highline, Highline Performance, Quiksilver Original, AG47, High Dye, etc.), Roxy (e.g., Performance, Syncro, Syncro Plus, Pop Surf, etc.), Billabong (e.g., Furnace Carbon Comp, Furnace Carbon, Furnace Comp, Revolution Tri Bong, Revolution Glide, Revolution Ninja, Revolution, Absolute X, Absolute Comp, Absolute, Pro-Series, etc.), Xcel (e.g., Comp, Axis, Drylock, Infiniti, Deborah Demi, Makaha Smoothskin, Karen Laser, Wanna Racerback, Robin Crossback, Jennifer, Marvic, Myrna, Grace Cross Back, Marisa, Doreen, Leslie, etc.), and Vissla (e.g., North Seas, 7 Seas, Eco Seas, Shonan Japanese, Chiba Japanese, Vissla X Bewet, etc.).

In addition to the wetsuits described above, other commercially available wetsuits and dry suits, or other wetsuits and dry suits, can be adapted to integrate with the leashes and/or other water sports accessories of the disclosure.

Other Water Sport Apparel

Other water sports apparel can include any apparel used or worn in a water sport, for example, triathlon suits, rashguards, neoprene shorts, pullovers, gloves, booties, hoods, capris, jackets, boater pants, board shorts, vests, surf shorts, swim suits, etc. Water sports apparel include those which are commercially available from O'Neill (e.g., boardshorts, rashguards, hybrid shorts, bikinis, one piece swimsuits, etc.), Hurley (e.g., compression shorts, compression shirts, boardshorts, rashguards, surf shirts, etc.), Patagonia (e.g., boardshorts, surf shorts, bikinis, rashguards, etc.), Rip Curl (e.g., boardshorts, bikinis, one piece swimsuits, rashguards, etc.), Quiksilver (e.g., boardshorts, rashguards, etc.), Roxy (e.g., board shorts, rashguards, bikinis, etc.), and Billabong (e.g., boardshorts, rashguards, bikinis, one piece swimsuits, etc.).

Leashes

Leashes assist a user in maintaining control of a surfboard or other water sports apparatus (e.g., rideables such as windsurfing boards, stand-up paddleboards, water skis, other towables, wakeboards, bodyboards, skim boards, kiteboards, fins, etc.) after a wipeout or other event that separates the user from the surfboard or other water sports apparatus. Commercial leashes can be comprised of a number of elements including, for example, a cuff, a cord, a rail saver, and a swivel. Standard commercially available leash cuffs are double wrap-around Velcro cuffs. Leash cords can be made of any material but are usually lightweight, e.g., polyurethane cords. In general, the cord will be stronger if it is thicker though a thick cord can create more drag in the water. Rail savers prevent a leash from putting too much pressure on the rail of a surfboard. The wider and longer the rail saver, the more it will protect the rail when the leash cord is taut (e.g., because a user has been separated from their board or water sports apparatus), but the more drag it will create in the water.

Leashes can range in length from a few feet to up to twelve (12) feet or more. The length of a leash can depend on the length of the board (or other water sports apparatus) and the skill level of the user. In general, a leash can be equal in length to the board (or other water sports apparatus) to which it is attached. A leash that is too long increases the distance the board (or other water sports apparatus) can travel, which can cause it to hit and injure others, while a leash that is too short can cause the board (or other water sports apparatus) to rebound and hit and injure the user. Two common leash widths are found in commercially sold competition leashes and regular leashes. Competition leashes can be around 3/16 of an inch in diameter (4.7 mm) and regular leashes can be around ¼ of an inch in diameter (6.35 mm).

Quick release leashes include an assembly for quickly separating a user from a board (or other water sport apparatus) when necessary, for example, for the safety of the user. Quick release assemblies include, for example, the Dakine Easy Clip Leash Release Pin, the NRS quick release belt system, the Badfish Re-Leash system (with a quick draw snap shackle), Salamander SUP quick release belt (adjustable Velcro release system), etc. These quick release assemblies allow a user to pull on a tab, ball, or loop to disengage the coupling assembly and release the user from the leash and the board (or water sports apparatus).

Examples of commercially available leashes that can be used with or adapted to the wetsuits, dry suits, and other water sports apparel disclosed herein include, for example, leashes sold by Channel Island Surfboards (e.g., Jordy Smith signature hex cords, Parker Coffin signature hex cords, Conner Coffin signature hex cords, CI hex cords, Dane Reynolds signature leash cylinder cord, Bobby Martinez signature hex cord leash, Soli Bailey comp leash, Soli Bailey regular leash, etc.), Creatures of Leisure (e.g., Lite, Comp, Reef, Outer Reef, Backdoor, Longboard, SUP, Pro, etc.), Dakine (e.g., John John Florence Kainui, John John Florence Comp, Plate Lunch X Procomp, Plate Lunch X Team, Procomp, Kainui Team, Superlite, Kainui, Peahi, Longboard, SUP, Coiled Bicep leash, Coiled wrist leash, deluxe fin leash, fin leash, etc.), FCS (e.g., FCS Premium, FCS Classic, FCS Longboard, etc.), Surf Station Surf Company (e.g., Surf Station surfboard leash, Surf Station Signature surfboard leash, etc.), On A Mission (e.g., Comp leash, Super Comp leash, Regular leash, Big Wave leash, etc.), Pro-Lite (e.g., Freesurf leash, Comp leash, Super Comp leash, Bodyboard leash, Comp/Knee leash, Survivor leash, etc.), and Stay Covered (e.g. Standard leash, Comp leash, XXL Big Wave leash, XXL Big Wave with Quick Release leash, etc).

Other Water Sport Accessories

Other water sports accessories besides leashes can include, for example, cameras, camera accessories, Fitbits, other personal fitness electronic devices, GPS devices (e.g., for tracking speed, distance, location), timepieces, electronic controllers (e.g., for a drone), smartphones, waterproof case, bag or pouch for a smartphone, sunglasses, head phones, other sound speakers, water bottle, shark repellent bracelet, etc. Water sports accessories that a user could utilize or operate during a water sport can be integrated with a water sports apparel (e.g., to a wetsuit or a dry suit).

Commercially available water sports accessories include, for example, ODRVM 4K WiFi camera (waterproof), ODRVM Action Camera 1080P (waterproof), Campak ACT74 Action Cam (waterproof), BrosFuture 4K Action Camera with WiFi (waterproof), GoPro cameras (with or without water sports bundle packs), EOTW waterproof cell phase case dry bag pouch, MPOW universal waterproof case, Kamota waterproof case for smartphones, LUXEAR sports sunglasses, sunfire red extreme sea specs sunglasses, Sharkbanz shark repellent bracelets, Rip Curl Search GPS watch (tracks top speed, distance, and wave count), Nixon surf watches (Ultratide, Mission, Descender Sport, October Tide, Lodown II, Lodown Silicon, Comp, Comp S, Unit, Unit Exp, Tangent, Base Tide Nylon), LAD Weather watches (GPS watch, Radio Master, Sensor Master II, GPS Master III, GPS Master IV, GPS Master V, Tritium Master, Tritium Master IV, Tritium Master V, Tritium Master VI, Solar Master, Snorkeling Master, Variant Master, Variant Master II), Rip Curl Watches (Rifles Tide, Rifles SS Tide, Rifles Midsize Tide, Atom Digital, Drifter Tide, Drifter Digital, Mayhem, Raglan Tide, Recon Auto, Recon, Drake, Covert, Cambridge, DVR-200, DVR-100, Flyer II, Tour, Ultra, Maverick, Agent, Havok, Pivot, Maui Mini Tide, Echo Beach, Candy, Aurora, Circa, Horizon Acetate, Lindsay, Horizon, Winki Oceansearch, Bailey, Trestles Pro World Tide, DVR Rotor), Yisuya Sport 3AM Dive, Fitbits, Twobefit fitness trackers (waterproof), Letufit fitness trackers (waterproof), Lyou fitness trackers, Kybeco fitness trackers, Coffea C2 activity wristbands, Dawo fitness trackers, Morefit fitness trackers, electronic controllers, etc.

The inventions disclosed herein will be better understood from the exemplary details which follow. However, one skilled in the art will readily appreciate that the specific methods and results discussed are merely illustrative of the inventions as described more fully in the claims which follow thereafter. Unless otherwise indicated, the disclosure is not limited to specific procedures, materials, or the like, and as such may vary. It is also to be understood that the terminology used herein is for the purpose of describing particular embodiments only and is not intended to be limiting.

EXAMPLES

Example 1: Integrated Wetsuit and Leash

Figure 1B:
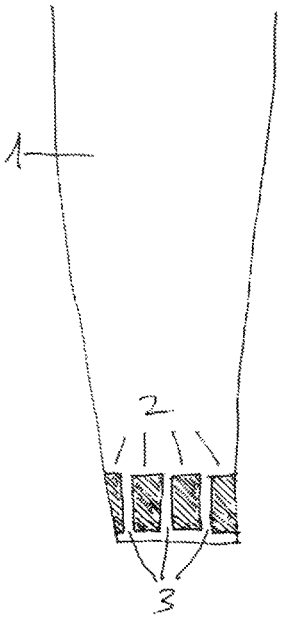
FIG. 1B and FIG. 1C show multiple discontinuities.
Figure 1C:
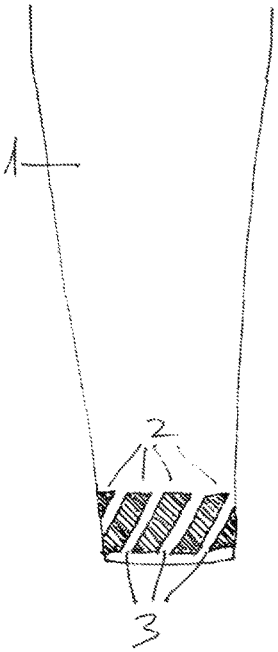

A wetsuit is modified to include a strip of Velcro loops around the right ankle by sewing the Velcro strip onto the right ankle region. FIG. 1 depicts several different ways to arrange the Velcro strip(s) on the wetsuit. FIG. 1A shows a single Velcro strip (2) attached on the ankle region of a wetsuit (1), where the Velcro strip (2) is continuous and does not fully encircle the wetsuit leg, leaving a single gap (3) that helps the wetsuit maintain its ability to stretch in the ankle region, facilitating wetsuit entry and exit. FIG. 1B and FIG. 1C show two other arrangements of Velcro strips (2) on the ankle region of a wetsuit (1) so that there are multiple breaks or gaps (3) in between the Velcro strips which allow the wetsuit to maintain its ability to stretch, facilitating wetsuit entry and exit.

Figure 2:
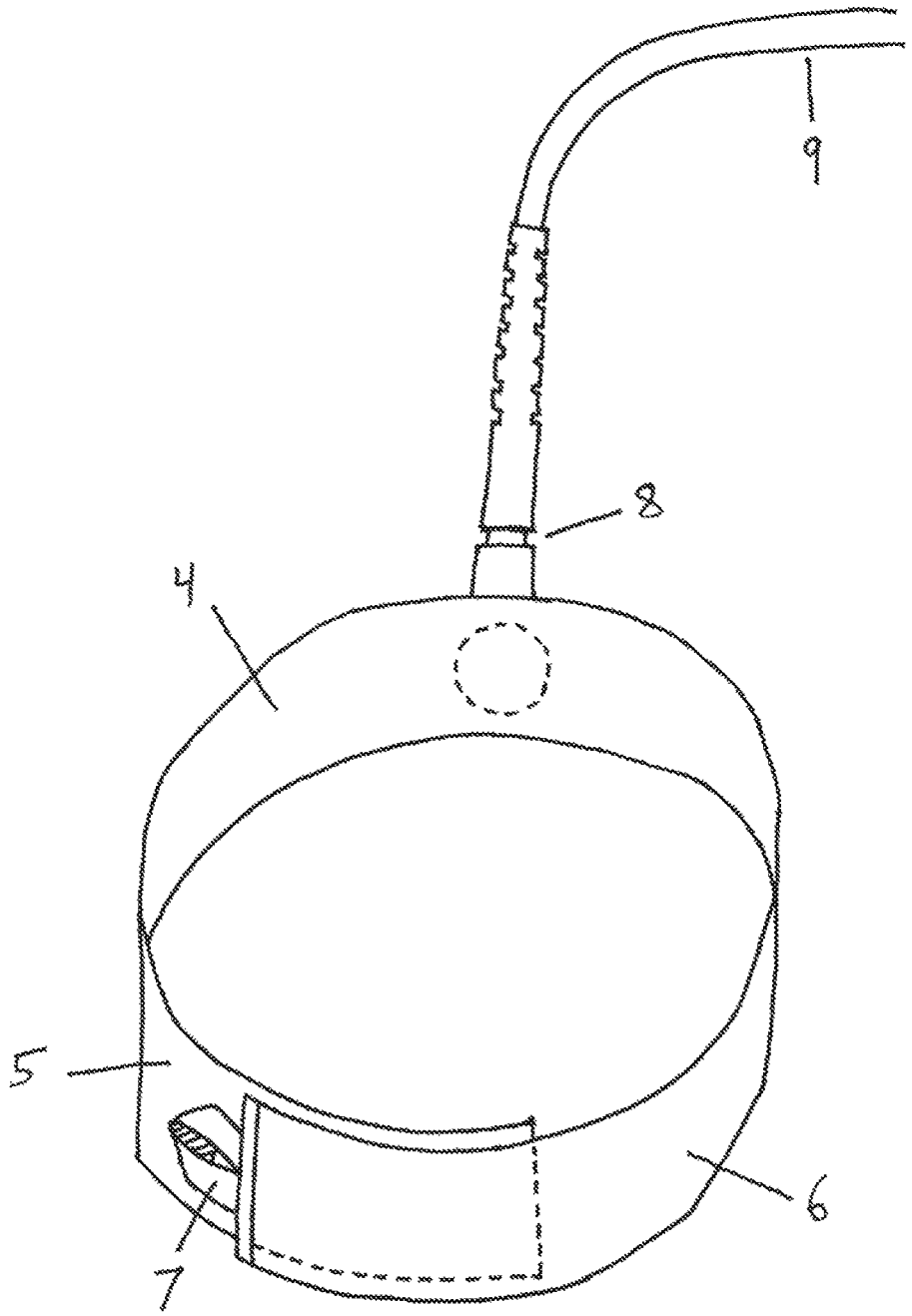
FIG. 2 shows an ankle cuff of a leash adapted for integration with a Velcro strip(s) attached to a wetsuit.

The leash cuff assembly of a Dakine Kainui Team leash is modified by removing the neoprene padding and Velcro strips. A new strip of Velcro hooks (about 18 inches×1.5 inches) is joined to the inner surface of the cuff assembly. A new strip of Velcro loops (about 7.5 inches×1.5 inches) is joined to the outer surface of the cuff assembly. The leash cuff assembly can be wrapped around a user's lower right leg, so that the strip of Velcro hooks on the leash cuff assembly can mate with the strip of Velcro loops that is sewn onto the wetsuit, allowing for fixed placement of the leash on a user. Any overhang of the Velcro hook strip (i.e., length in excess of the circumference of the user's lower leg) can be applied to the Velcro loop strip on outer surface of the leash cuff assembly. FIG. 2 depicts a leash that has been modified for integration with a wetsuit. A strip of Velcro hooks (4) is placed on the inner surface of the leash cuff assembly. A strip of Velcro loops (5) is placed at one end of the outer surface (6) of the leash cuff assembly. A pull tab (7) is placed at the other end of the outer surface (6) of the leash cuff assembly. This modified cuff assembly is attached to a standard leash cord (9) through a swivel assembly (8).

The integrated wetsuit and leash reduces entanglement of the leash with a surfer's feet while surfing and eliminates the need to continually monitor and adjust the orientation of the leash cuff during a surfing session. In addition, the leash is maintained in a fixed position above the ankle joint, allowing for full and unimpeded range of motion of the ankle joint during a surfing session. Further, removal of the leash is easily accomplished, because the leash does not swivel around a surfer's ankle when unfastening the mated Velcro strips on the wetsuit and leash. Further still, because the leash lacks the layer of neoprene padding found on commercial leashes, it is lighter in weight, less bulky, easier to clean, faster to dry, and produces less drag in the water.

Leashes currently used by surfers are able to swivel around their ankle while they surf, causing entanglement of the leash with their feet. This can cause a surfer to lose their balance and wipe out. Even if a surfer does not fall off their surfboard, stepping on or getting entangled with their leash may prevent the surfer from maximizing a wave's potential, as secure contact between the surfer's feet and their surfboard is necessary for executing critically timed maneuvers on the wave face and above the lip. Some surfers will tuck the leash cuff underneath their wetsuit to try and maintain the leash cuff in a constant orientation (e.g., so that the swivel assembly and leash cord point behind the surfer or outward and away from their feet). However, the leash cuff can still swivel under the wetsuit or dislodge from underneath the wetsuit, and placing the cuff underneath the wetsuit breaks the seal between the wetsuit and the user's lower leg, allowing cold water to flush the wetsuit at the lower leg. Current leashes also tend to settle at a user's ankle joint, causing discomfort and impeding full range of motion at the ankle joint. Further, removing current leashes can be difficult, as they tend to swivel around a user's leg when attempting to unfasten the Velcro closure. The integrated leash and wetsuit described herein overcomes these problems of current leashes and wetsuits.

Example 2: Integrated Wetsuit Bootie and Leash

A right wetsuit bootie is modified to include a strip of Velcro loops around the ankle region by sewing the Velcro strip to the ankle region. The Velcro strip may be continuous or discontinuous, as in Example 1.

The ankle cuff assembly of a Dakine Kainui Team leash is modified as in Example 1. The strip of Velcro hooks on the leash can mate with the strip of Velcro loops on the bootie, allowing for fixed placement of the leash on a user wearing the bootie.

Example 3: Integrated Wetsuit and Timepiece

A wetsuit is modified to include a strip of Velcro loops around the left wrist by sewing the Velcro strip onto the left wrist. The Velcro strip may be continuous or discontinuous, as in Example 1.

A timepiece is modified to include a watch band having an inner surface comprising a strip of Velcro hooks. The Velcro strip may be continuous or discontinuous, and can mate with the strip of Velcro loops at the wrist of the wetsuit, allowing for fixed placement of the timepiece on the wetsuit.

Timepieces currently used during water sports activities can freely rotate around a user's wrist such that the display can frequently be oriented away from the user. This can require the user to frequently adjust their timepiece so that they can check the time, tides, etc. Timepieces can also slide laterally along a user's forearm and tend to settle at and cover the wrist joint when a user is wearing a wetsuit. This can cause discomfort as well as impede full range of motion at the wrist joint, for example, when paddling. The integrated timepiece and wetsuit described herein overcome these problems of current timepieces and wetsuits.

Example 4: Integrated Wetsuit and Timepiece

A wetsuit is modified to include a strip of Velcro loops around the left wrist by sewing the Velcro strip onto the left wrist. The Velcro strip may be continuous or discontinuous, as in Example 1.

A timepiece is integrated with an attachment assembly comprising a continuous or discontinuous strip of Velcro hooks as well as slits or loops allowing for insertion of the bands of the timepiece. The strip of Velcro hooks can mate with the strip of Velcro loops at the wrist of the wetsuit and the timepiece can be fastened as it normally would, allowing for fixed placement of the timepiece on the wetsuit. The timepiece and wetsuit can thus be integrated without direct physical contact between the timepiece and the wetsuit.

Example 5: Integrated Wetsuit Hood and Camera

A wetsuit hood is modified to include a Velcro cinch strap by sewing a portion of the cinch strap onto the hood. A camera is modified to include a slot, or to integrate with an attachment assembly comprising a slot, which can integrate with the Velcro cinch strap, allowing for fixed placement of the camera on the hood.

Example 6: Convertible Leash

A wetsuit and leash are modified as in Example 1. A new strip of Velcro loops (about 9.75 inches×1.5 inches) is sewn onto the neoprene padding from the original commercial leash, and can mate with the strip of Velcro hooks on the inner surface the modified leash. In this way, the modified leash can be converted back to the commercial leash for use in warmer water temperatures, for example, when a user does not need to wear a wetsuit. The neoprene padding protects the user's skin from the Velcro hooks on the inner surface of the modified leash.

Example 7: Multi-Use Leash

A Dakine Kainui Team leash is modified to have two interchangeable cuff assemblies. One cuff assembly is a standard Dakine Kainui Team leash cuff assembly. The other cuff assembly is a standard Dakine Kainui Team leash cuff assembly modified as in Example 1. The leash cord can couple to either cuff assembly through, for example, a detachable swivel assembly or quick release assembly. A user is able to use the leash with the standard cuff assembly, for example, when not wearing a wetsuit. The user is able to use the leash with the modified cuff assembly, for example, when wearing a wetsuit that has been modified as in Example 1.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited.

Those skilled in the art will recognize, or be able to ascertain using no more than routine experimentation, many equivalents to the specific embodiments described herein. Such equivalents are intended to be encompassed by the following claims.

I claim:

1. A wetsuit comprising a first attachment assembly for a leash located at a desired position on the wetsuit and a leash comprising a cord and a second attachment assembly for the wetsuit, wherein the first attachment assembly is complementary to the second attachment assembly, and wherein the first attachment assembly is joined to the second attachment assembly.

2. The wetsuit of claim 1, wherein the first attachment assembly is located on the wetsuit at an ankle, a calf, a waist, a bicep, or a wrist.

3. The wetsuit of claim 2, wherein the first attachment assembly is located on the wetsuit at a wrist.

4. The wetsuit of claim 2, wherein the first attachment assembly is located on the wetsuit at an ankle.

5. The wetsuit of claim 1, wherein the first attachment assembly is a means for hook and loop closure and the second attachment assembly is a complementary means for hook and loop closure.

6. The wetsuit of claim 5, wherein the means for hook and loop closure on the wetsuit is discontinuous.

7. The wetsuit of claim 6, wherein the means for hook and loop closure forms a set of stripes or strips on the wetsuit.

8. The wetsuit of claim 1, wherein the first attachment assembly is a bar assembly.

9. The wetsuit of claim 1, wherein the leash further comprises a first swivel assembly located between the cord and the second attachment assembly.

10. The wetsuit of claim 9, wherein the leash further comprises a rail saver located at an end of the cord.

11. The wetsuit of claim 10, wherein the leash further comprises a second swivel assembly located between the rail saver and the cord.

12. The wetsuit of claim 1, wherein the first attachment assembly and the second attachment assembly are complementary parts of a quick release assembly.

13. The wetsuit of claim 1, wherein the second attachment assembly is a rail saver, wherein the rail saver is located at an end of the cord.

14. The wetsuit of claim 5, wherein the leash further comprises a first swivel assembly located between the cord and the second attachment assembly.

15. The wetsuit of claim 14, wherein the leash further comprises a rail saver located at an end of the cord.

16. The wetsuit of claim 15, wherein the leash further comprises a second swivel assembly located between the rail saver and the cord.

17. The wetsuit of claim 5, wherein the leash further comprises a quick release assembly.

* * * * *